US008863433B2

(12) United States Patent
Kruse

(10) Patent No.: US 8,863,433 B2
(45) Date of Patent: Oct. 21, 2014

(54) GUN SIGHT WITH SINGLE POINT REFERENCE

(71) Applicant: I.P. Holding Group I, LLC., St. Louis, MO (US)

(72) Inventor: Russell E. Kruse, St. Charles, MO (US)

(73) Assignee: I.P. Holding Group I, LLC., St. Louis, MO (US)

( * ) Notice: Subject to any disclaimer, the term of this patent is extended or adjusted under 35 U.S.C. 154(b) by 0 days.

(21) Appl. No.: 13/645,680

(22) Filed: Oct. 5, 2012

(65) Prior Publication Data

US 2014/0096430 A1 Apr. 10, 2014

(51) Int. Cl.
*F41G 1/01* (2006.01)

(52) U.S. Cl.
USPC ..... 42/111; 42/132; 42/144

(58) Field of Classification Search
CPC ..... F41G 1/00; F41G 1/01; F41G 1/02; F41G 1/06; F41G 1/10; F41G 1/12; F41G 1/345; F41G 1/425
USPC ..... 42/111, 132, 133, 135, 136, 142, 144, 42/145
See application file for complete search history.

(56) References Cited

U.S. PATENT DOCUMENTS

| | | | | | |
|---|---|---|---|---|---|
| 882,182 | A | | 3/1908 | Thompson | |
| 943,872 | A | * | 12/1909 | Gordon | 42/133 |
| 1,094,265 | A | * | 4/1914 | Stewart | 42/144 |
| 1,171,310 | A | | 2/1916 | Bisbee | |
| 1,268,537 | A | | 6/1918 | Bader | |
| 1,292,211 | A | * | 1/1919 | Young et al. | 42/140 |
| 1,307,441 | A | | 6/1919 | Frensdorf | |
| 1,755,635 | A | | 4/1930 | Dindinger | |
| 2,607,993 | A | * | 8/1952 | McKay | 42/144 |
| 2,706,335 | A | | 4/1955 | Munsey | |
| 2,806,288 | A | * | 9/1957 | Sarvis | 42/136 |
| 3,495,338 | A | * | 2/1970 | Ullman | 42/144 |
| 3,499,224 | A | | 3/1970 | Squier et al. | |
| D382,038 | S | | 8/1997 | Nigh | |
| 5,822,872 | A | | 10/1998 | Waki | |
| 5,887,352 | A | * | 3/1999 | Kim | 42/144 |
| 6,058,616 | A | * | 5/2000 | Bubits | 42/144 |
| 6,321,479 | B1 | * | 11/2001 | Sheehan | 42/111 |
| 6,360,471 | B1 | | 3/2002 | Stein | |
| 6,711,846 | B1 | * | 3/2004 | Nasef | 42/130 |
| D519,184 | S | | 4/2006 | Malley | |
| 7,451,566 | B1 | | 11/2008 | Price | |
| 7,832,138 | B1 | | 11/2010 | Price | |
| 2010/0077647 | A1 | * | 4/2010 | Kraft | 42/144 |

(Continued)

*Primary Examiner* — Bret Hayes
*Assistant Examiner* — Derrick Morgan
(74) *Attorney, Agent, or Firm* — Polster Lieder

(57) ABSTRACT

The present disclosure provides a gun sight system that utilizes vernier acuity to provide a single point of sight for aiming that requires little or no visual and mental estimation such that the respective firearm can be quickly, easily and accurately aimed at a still or moving target. The sight system includes a front sight comprising a sighting structure extending substantially orthogonally from the end of the slide that includes a 'V-shaped' notch in a distal end. The system additionally includes a rear sight comprising a sighting stud extending substantially orthogonally from a rear of the slide includes a 'inverted-V-shaped' tip such that when a user looks longitudinally along the top of the slide, the user can align an apex of the rear sight 'inverted-V-shaped' tip with a nadir of the front sight 'V-shaped' notch with the target nested within the front sight 'V-shaped' notch to accurately aim the firearm.

27 Claims, 12 Drawing Sheets

(56) References Cited

U.S. PATENT DOCUMENTS

2011/0067286 A1* 3/2011 Price ..... 42/111
2012/0131833 A1* 5/2012 Lippard ..... 42/69.01
2012/0151817 A1* 6/2012 Howe et al. ..... 42/132
2012/0198750 A1* 8/2012 Mansfield ..... 42/132
2013/0185984 A1* 7/2013 Glimpse et al. ..... 42/132
2013/0255129 A1* 10/2013 Curry ..... 42/144

* cited by examiner

GUN SIGHT WITH SINGLE POINT REFERENCE

FIELD

The present teachings relate to a front and rear sight system used on firearms including pistols, rifles and shotguns that features a single point of sight that requires little or no mental estimation.

BACKGROUND

The statements in this section merely provide background information related to the present disclosure and may not constitute prior art.

Traditional sights for a firearm, also known as "iron sights", comprise a rear sight formed of an opaque solid block having a square or rectangular notch formed in the upper surface of the block and a front sight formed as a vertical blade or post. When such sights are used to aim the respective firearm, the front sight blade must be viewed through the rear sight notch and lined up horizontally with the top of the rear sight block and vertically with sides of the notch in the rear sight block.

More specifically, when using such "iron sights", proper sighting is assumed when the flat top surface of the front sight post appears to be even with the flat top surface of the rear sight, and when the two opposing flat sides of the front sight post appear to be exactly centered between the two interior flat sides of the rear sight notch. Therefore, to properly sight a target, the user must visually and mentally estimate when the two gaps appearing between sides of the front sight post and the left and right sides of the rear sight notch are equal. And, additionally, the user must at the same time visually and mentally estimate when the flat upper surfaces of the front and rear sights are aligned. Moreover, while holding these vertical and horizontal alignments, the user must align a general area of a top of the front sight post with the intended target.

Therefore, alignment of such "iron sights" is a timely process due to the requirement of lining up three points of sight, i.e., the vertical alignment of the front sight blade with both sides of the notch in the rear sight block and the horizontal alignment of the top of the front sight blade with the top of the rear sight block. This timely process inhibits quick and accurate acquisition of the target and aiming of the firearm. Additionally, because the sights are opaque, "iron sights" tend to obscure the view of portions of the target and/or the area surrounding the target, thereby further inhibiting quick and accurate acquisition of the target and aiming of the firearm.

A number of variations of the "iron sights" are known, for example, the front sight can comprise a small round bead disposed on top of a post; the notch in the rear sight can be 'V-shaped'; or the sights can be what is referred to as a "Peep Sight" comprised of a fully enclosed round opening (or ring) on the rear sight, which is indexed to a bead and post front sight. Some other known variations include front sights which are triangle or diamond shaped, or circular. In other know variations, the front sight post includes a white dot and the rear sight includes a white dot on each of the left and right sides of the notch such that the three dots are visually and mentally aligned together in an even row along with the target. All these variations have a common and consistent theme, wherein they all have open spaces or gaps which are the only references for proper alignment. Hence, proper alignment and aiming of the respective firearm is time consuming, requires visual and mental estimation, and the sights obscure the view of portions of the target and/or the area surrounding the target, thereby inhibiting quick and accurate acquisition of the target and aiming of the firearm.

SUMMARY

The present disclosure provides a gun sight system that utilizes vernier acuity, and in various embodiments excitement of human eye receptors, to provide a single point sight for aiming that requires little or no visual and mental estimation such that the respective firearm can be quickly, easily and accurately aimed at a still or moving target. In various embodiments, the sight system includes a front sight comprising a base that is structured and operable to mount the front sight to a distal end of a barrel or slide of a firearm, and a sighting structure extending from the base such that the sighting structure extends substantially from the barrel/slide. The front sight sighting structure includes a 'V-shaped' notch in a distal end.

Additionally, the sight system includes a rear sight comprising a body structured and operable to mount the rear sight to a proximal end of the barrel/slide. The rear sight body includes a sight channel formed in a top of the body, wherein the sight channel has an axis that is substantially parallel to a longitudinal axis of the barrel. When a user looks longitudinally along the top of the barrel, the sight channel provides a field of view that includes the front sight sighting structure, a target and a panoramic view of the area around the target whereby the target can be viewed, even if it is in motion. The rear sight further comprises a sighting stud extending orthogonally from a bottom surface of the sight channel such that the sighting stud extends substantially orthogonally from the barrel or slide. A distal end of the sighting stud has an 'inverted-V-shaped' tip such that when a user looks longitudinally along the top of the barrel, the user can align an apex of the rear sight 'inverted-V-shaped' tip with a nadir of the front sight 'V-shaped' notch with the target nested within the front sight 'V-shaped' notch to accurately aim the firearm.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
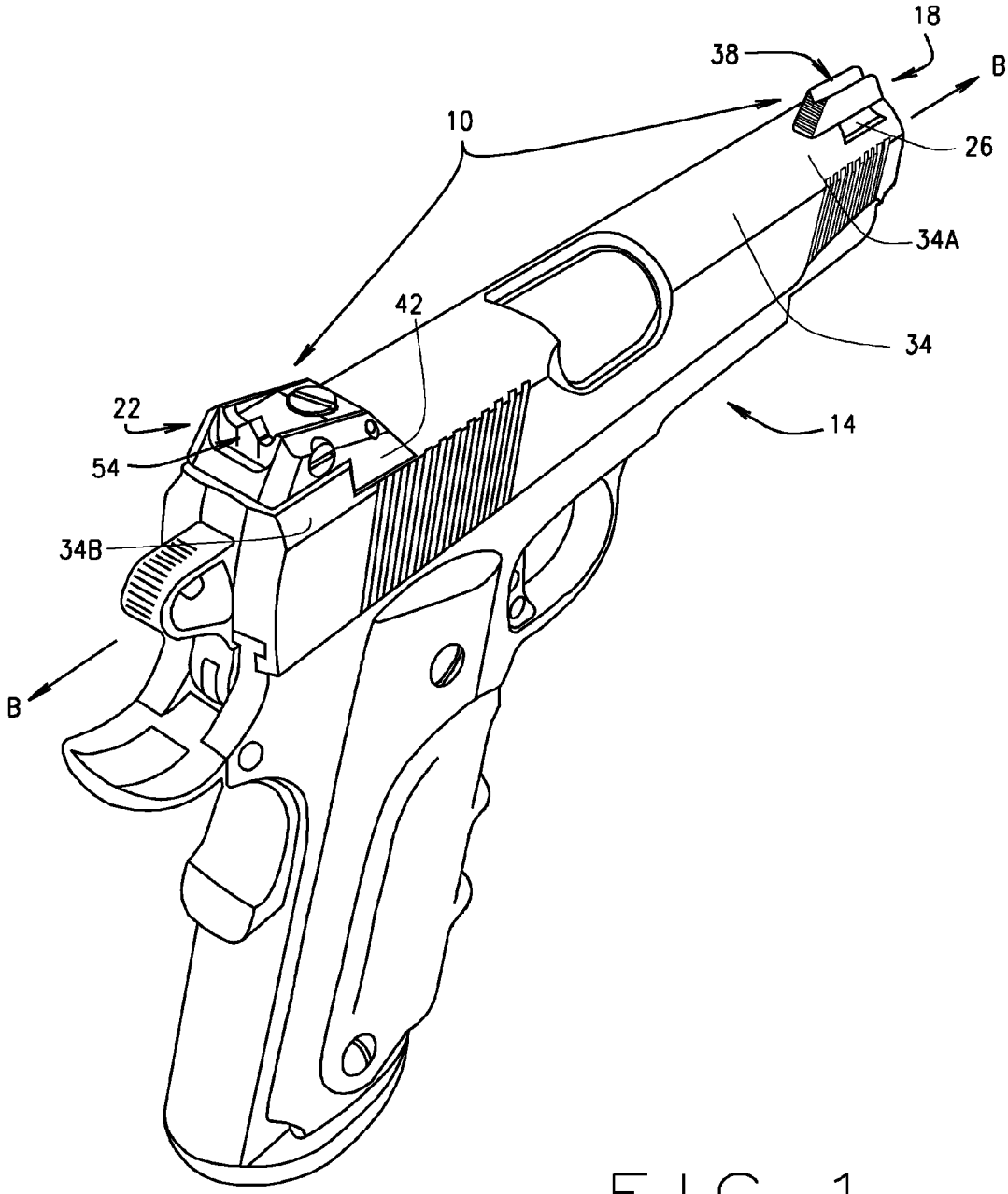
FIG. 1 is an isometric view of a pistol including a gun sight system in accordance with various embodiments of the present disclosure.

The following description is merely exemplary in nature and is in no way intended to limit the present teachings, application, or uses. Throughout this specification, like reference numerals will be used to refer to like elements.

Referring to FIG. 1, the present disclosure provides a gun sight system 10 that utilizes vernier acuity to provide a single point of sight for aiming that requires little or no visual and mental estimation when aiming a firearm 14, (e.g., a pistol, rifle or shotgun) to which the sight system 10 is mounted. Thus, the respective firearm 14 can be quickly, easily and accurately aimed at a still target or a moving target. More specifically, the sight system 10 includes a front sight 18 and a rear sight 22 that are cooperatively structured and operable to visually form an 'X' sighting pattern that utilizes the vernier acuity of the user's eye such that only a single point of alignment of the front sight 18 with the rear sight 22 and with the target is necessary to easily, accurately and quickly aim the firearm 14, regardless of firing distance or complexity of the target.

Vernier acuity is sometimes referred to as hyperacuity, because its resolution is much higher than that of visual acuity. Hyperacuity is what causes precision readings of a sliding caliper used by machinists etc. Vernier acuity corresponds to "recognition of relative position" of a broken line.

Generally, visual acuity is measured by the smallest letters that can be distinguished on a chart and is governed by the anatomical spacing of the mosaic of sensory elements on the retina, i.e. retinal 'pixels'. However, utilizing hyperacuity, spatial distinctions can be made on a finer scale, e.g., misalignment of borders can be detected with a precision up to 10 times better than visual acuity. Hyperacuity depends on sophisticated information processing in the brain and far transcends the size limits set by the retinal 'pixels'.

An example of hyperacuity is vernier acuity in which the alignment of two edges or lines can be judged with a precision up to ten times better than visual acuity. Generally, a sophisticated circuitry in the brain identifies the location of a visual feature by assessing the "center of gravity" of the light over several receptors, a task that can be accomplished with much higher precision than the resolution limit set by the receptor spacing. For example, what is involved with vernier acuity is not resolution (i.e., is there one or two?—a qualitative distinction) but rather localization (i.e., exactly where?—a quantitative judgment).

Referring now to FIGS. 1 through 7, in various embodiments, the front sight 18 includes a base 26 and an opaque solid sighting structure 30 that extends orthogonally from the base 26. The base 26 is structured and operable to mount the front sight 18 to a distal end 34A of a barrel or slide 34 of the firearm 14, such that the sighting structure 30 extends substantially orthogonally from the barrel/slide 34 when the front sight 18 is mounted to the barrel/slide 34. As is readily understood by one skilled in the art some firearms, e.g., rifles have a barrel to which the sight system 10 would be mounted, while other firearms, e.g., some pistol models (as exemplarily shown in FIG. 1) have slide 34 to which the sight system 10 would be mounted. However, for convenience, brevity and clarity, the barrel or slide 34 of the respective firearm (rifle, pistol or shotgun) will be referred to herein as simply the slide 34. Hence, throughout the description and claims herein the term slide 34 will be understood to mean the barrel or the slide of the respective firearm 14 to which the sighting system 10 is to be, or is, mounted.

In such embodiments, the front sight sighting structure 30 can be any suitable structure that is integrally formed with, or connected to, the base 26 such that the sighting structure 30 extends orthogonally from the base 26, such as a blade, stud, post, pin or boss of any suitable shape, e.g., a cylinder, a cube, a polyhedron, an ovoid, etc. Additionally, the front sight sighting structure 30 can have a height h of any desired length suitable for use on the respective firearm 14. Importantly, the front sight sighting structure 30 includes a 'V-shaped' notch 38 in a top or distal end 30A. The V-shaped notch 38 includes a first wall or surface 38A connected to a second wall or surface 38B at a bottom or nadir 38C of the V-shaped notch 38 thereby forming the V-shaped notch 38.

The rear sight 22 comprises a body 42 that includes a bridge 58 formed in a top of the body 42 that defines a sight channel or window 46. The rear sight 22 additionally includes an opaque solid sighting stud 50 extending orthogonally from a bottom surface of the sight channel 46, i.e., the sighting stud 50 extends orthogonally from a top surface of the bridge 58. The body 42 is structured and operable to mount the rear sight 22 to a proximal end 34B of a slide 34, such that the sighting stud 50 extends substantially orthogonally from the slide 34 when the rear sight 22 is mounted to the slide 34.

Figure 3:
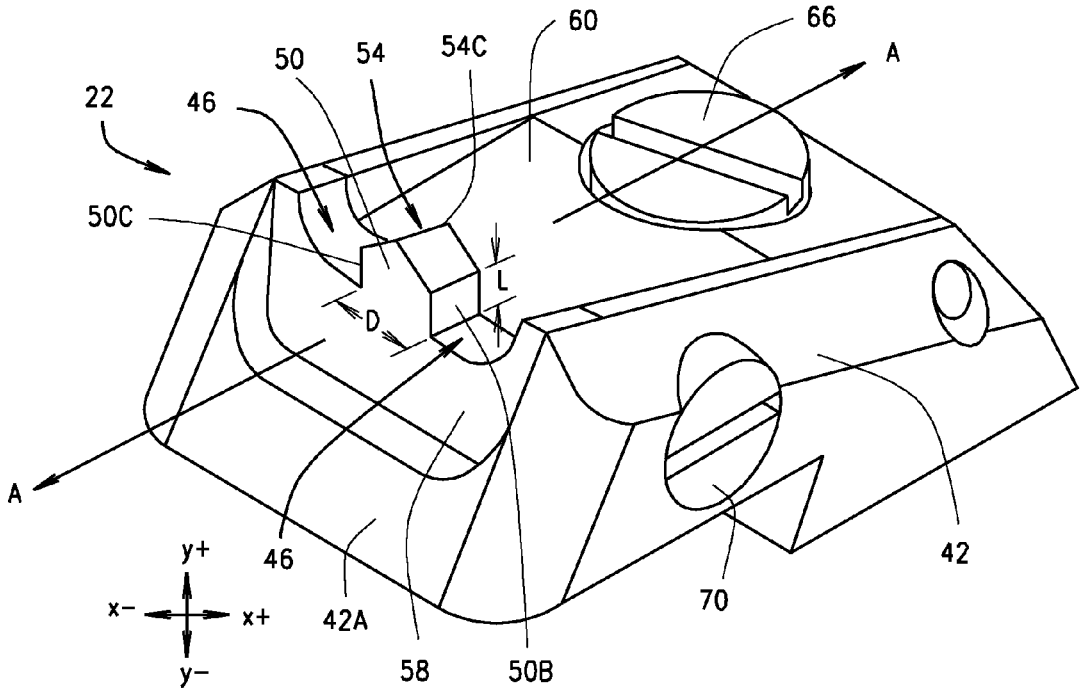
FIG. 3 is an isometric view of a rear sight of the gun sight system shown in FIG. 1, in accordance with various embodiments of the present disclosure.

As exemplarily illustrated in FIG. 3, in various embodiments the rear sight 22 can have an elongated body 42 that includes a depressed surface 60 disposed behind the bridge 58, with regard to direction of sight by the user as the user looks along the respective slide 34. The depressed surface 60 provides a window that prevents the elongated body from interfering with the line of sight, or view or the target, as the user looks longitudinally along the slide 34 when sighting/aiming the firearm 14. Alternatively, as exemplarily illustrated in FIG. 3A, the rear sight 22 can have a shorter longitudinal length that is absent the elongated portion of the body 42 and the depressed surface 60.

The rear sight sighting stud 50 can be any suitable structure that is integrally formed with, or connected to, the channel 46 such that the sighting stud 50 extends orthogonally from the channel 46, such as a blade, stud, post, pin or boss of any suitable shape, e.g., a cylinder, a cube, a polyhedron, an ovoid, etc. Importantly, a top or distal end 50A of the rear sight sighting stud 50 is formed to have 'inverted-V-shaped' tip 54. The inverted-V-shaped tip 54 includes a first wall or surface 54A connected to a second wall or surface 54B at a top or apex 54C of the inverted-V-shaped tip 54 thereby forming the inverted-V-shaped tip 54. Additionally, as exemplarily illustrated in FIGS. 3 and 3A) the rear sight sighting stud 50 can have a height L of any desired length suitable for use on the respective firearm 14 and based on the height and structure of the bridge 58.

The sight channel 46 has an axis A that is substantially parallel to a longitudinal axis B of the slide 34. Importantly, the sight channel 46 has a width M that provides the user with an open window to have an unobstructed view of a target 62 (shown in FIG. 5) and the area surrounding the target as the user looks longitudinally along the slide 34 when sighting/aiming the firearm 14. For example, in various embodiments, the channel width M can be between approximately 1/16 of an inch and 2 inches e.g., ½ of an inch to ⅝ of an inch. Therefore, when a user looks longitudinally along the top of the slide 34, the wide sight channel 46 provides an unobstructed field of view that includes the front sight sighting structure 30, the respective target and a panoramic view of the area around the target, such that the surrounding area and the target can be viewed simultaneously. Thus, among other benefits, the wide width M of the sight channel 46 allows the user to clearly see around the front sight sighting structure 30 such that the user can sight/aim the firearm 14 very quickly in situations where only approximate sighting/aiming is required. Additionally, to accurately aim the firearm 14, a user can look through the wide sight channel 46 and longitudinally along the top of the slide 34 to easily view and align the apex 54C of the rear sight inverted-V-shaped tip 54 with the nadir 38C of the front sight V-shaped notch 38 and with the target 62.

Importantly, when the user aligns the apex 54C of the rear sight inverted-V-shaped tip 54 with the nadir 38C of the front sight V-shaped notch 38 the corresponding walls 38A, 38B, 54A and 54B of the V-shaped notch 38 and the inverted-V-shaped tip 54 form an 'X'. Furthermore, to align the apex 54C of the rear sight inverted-V-shaped tip 54 with the nadir 38C of the front sight V-shaped notch 38, that is, to align the walls 38A, 38B, 54A and 54B of the V-shaped notch 38 and the inverted-V-shaped tip 54 to form the 'X', the user utilizes his/her vernier acuity to quickly and accurately form the 'X'. Additionally, to accurately sight the firearm 14, the user only need to align a single point, i.e. the apex 54C with the nadir 38C, of sight system 10. Hence, the sight system 10, as described herein, utilized the vernier acuity of the user to very accurately align a single point of the front and rear sights 18 and 22 with the target 62. It should be understood that the sight system 10 can be adjusted, in accordance with the user's preference, such that any portion of the target 62 can be aligned with the aligned apex 54C and nadir 38C of the front sight V-shaped notch 38, or the target 62 can be nested within the V-shaped notch 38, as exemplarily illustrated in FIG. 5.

For example, as exemplarily illustrated in FIG. 3, in various embodiments, the rear sight 22 can include a vertical adjustment device 66, e.g., an adjustment screw, that is structured and operable to raise and lower the apex 54C of the rear sight sighting stud 50 to adjust for projectile impact on the target. Additionally, in various embodiments, the rear sight 22 can include a horizontal adjustment device 70, e.g., an adjustment screw, that is structured and operable to the apex 54C of the rear sight sighting stud 50 from side-to-side to adjust for target windage and location of the target.

Referring now to FIGS. 2, 2A, 2B, 4, 4A, 6 and 7, in various embodiments, an angle α formed at the connection of the first and second walls 38A and 38B of the V-shaped notch 38 is substantially equal to an angle β formed at the connection of the first and second walls 54A and 54B of the inverted-V-shaped tip 54. In various implementations, the angles α and β are substantially equal to 90°.

Figure 4:
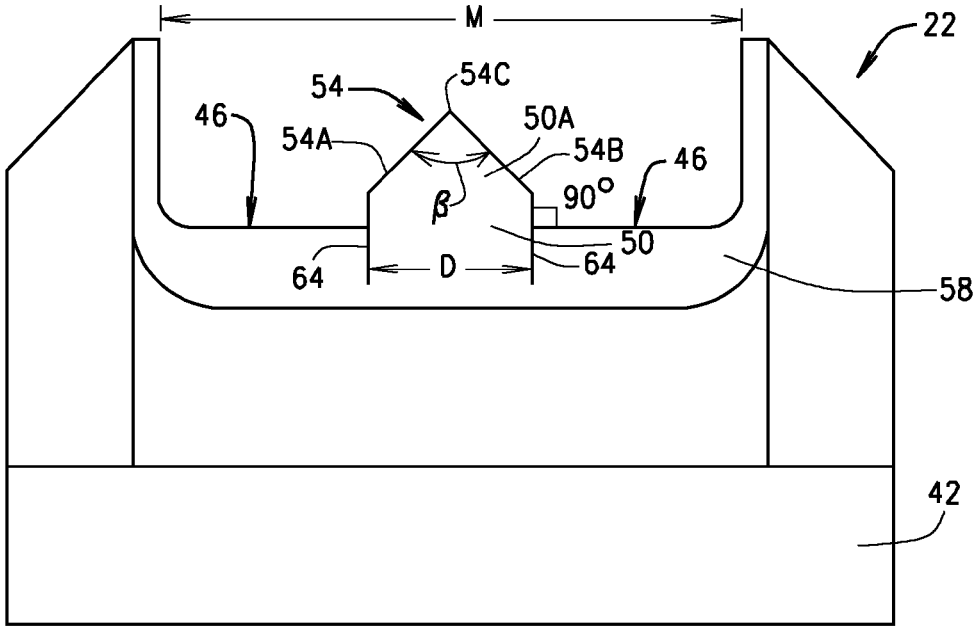
FIG. 4 is a rear view of the rear sight shown in FIG. 3, in accordance with various embodiments of the present disclosure.
Figure 4A:
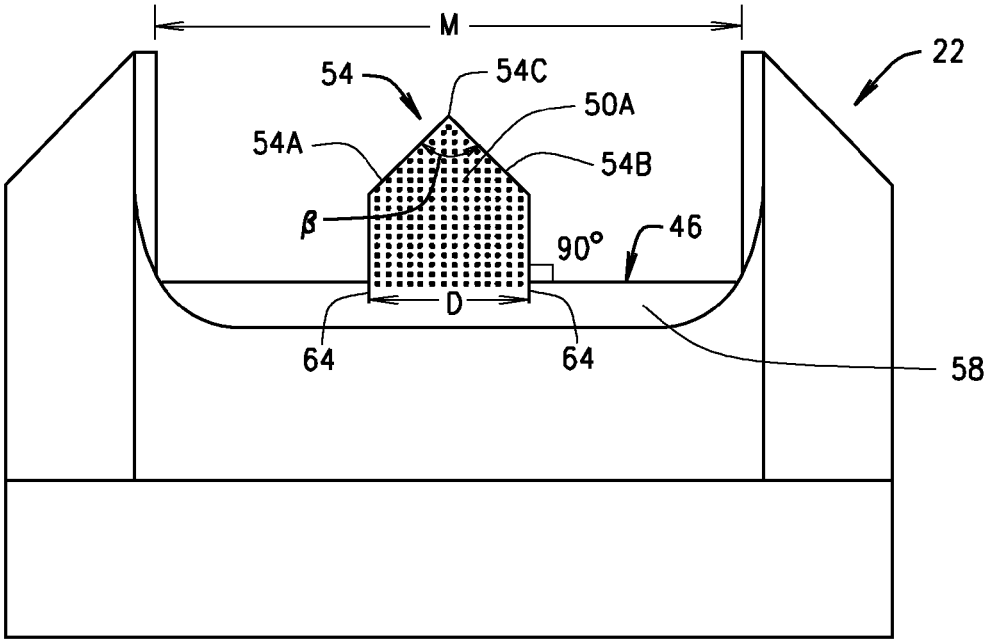
FIG. 4A is a rear view of the rear sight of the gun sight system shown in FIG. 3, illustrating a high visibility marking disposed at least on the solid rear face of an inverted-V-shaped tip, in accordance with various embodiments of the present disclosure.
Figure 6:
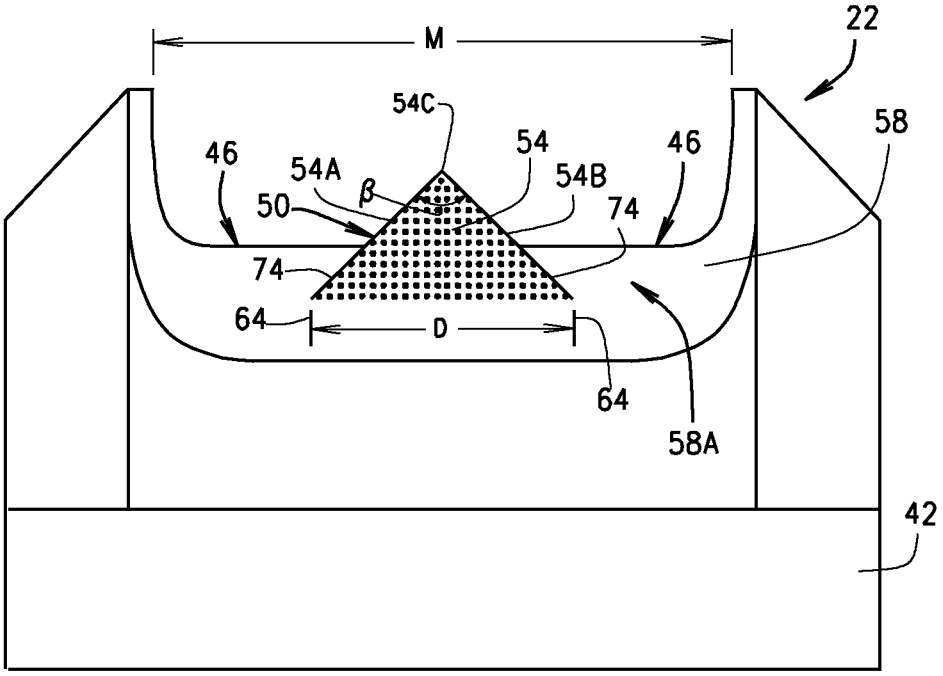
FIG. 6 is a rear view of the rear sight of the gun sight system shown in FIG. 1, in accordance with various other embodiments of the present disclosure.
Figure 7:
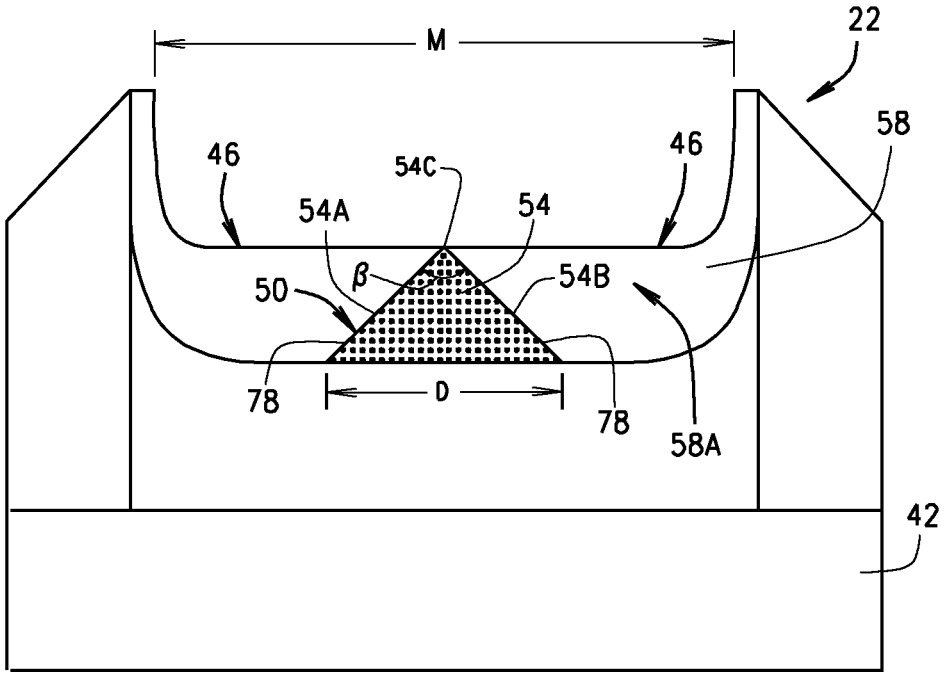
FIG. 7 is a rear view of the rear sight of the gun sight system shown in FIG. 1, in accordance with yet other embodiments of the present disclosure.

In various other embodiments, the rear sight sighting stud 50 can include a high visibility marking disposed at least on the solid rear face of the inverted-V-shaped tip 54 (shown as speckled marks on the rear face of the inverted-V-shaped tip 54 in FIGS. 4A, 6 and 7). For example the high visibility marking can be a high resolution or fluorescent paint or other coating disposed on the sighting stud 50, e.g., a fluorescent green marking. Similarly, in various embodiments, the front sight sighting structure 30 can includes a high visibility marking disposed at least on the solid rear face of the V-shaped notch 38 (shown as speckled marks on the rear face 30B of the sighting structure 30 in FIG. 2B). For example the high visibility marking can be a high resolution or fluorescent paint or other coating disposed on the sighting structure 30, e.g., a fluorescent red marking. Particularly, in such embodiments the high visibility markings on the front sight sighting structure 30 and the rear sight sighting stud 50 are visually contrasting such that the respective high visibility markings are clearly distinguishable from each other and thereby assist the user in aligning the apex 54C of rear sight inverted-V-shaped tip 54 with the nadir 38C of front sight sighting structure V-shaped notch 38 to quickly and accurately sight the firearm 14. Visually contrasting colors that directly oppose each other on the color wheel, for example high resolution or fluorescent red and green, have been proven scientifically to excite human eye receptors. Accordingly, the high visibility marking disposed on the solid rear faces of the sighting structure 30 and the sighting stud 50, clearly distinguish the sighting structure 30 and the sighting stud 50 from each other when the user is sighting/aiming the respective firearm 14, as described above, thereby assist the user in quickly and accurately sighting/aiming the firearm 14.

Figure 2:
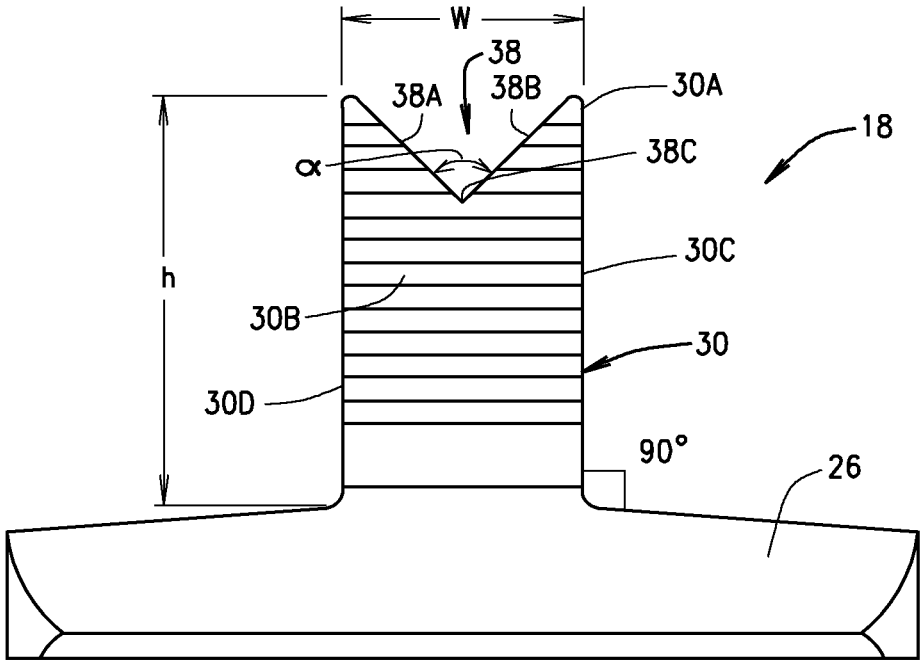
FIG. 2 is a rear view of a front sight of the gun sight system shown in FIG. 1, in accordance various embodiments of the present disclosure.
Figure 2A:
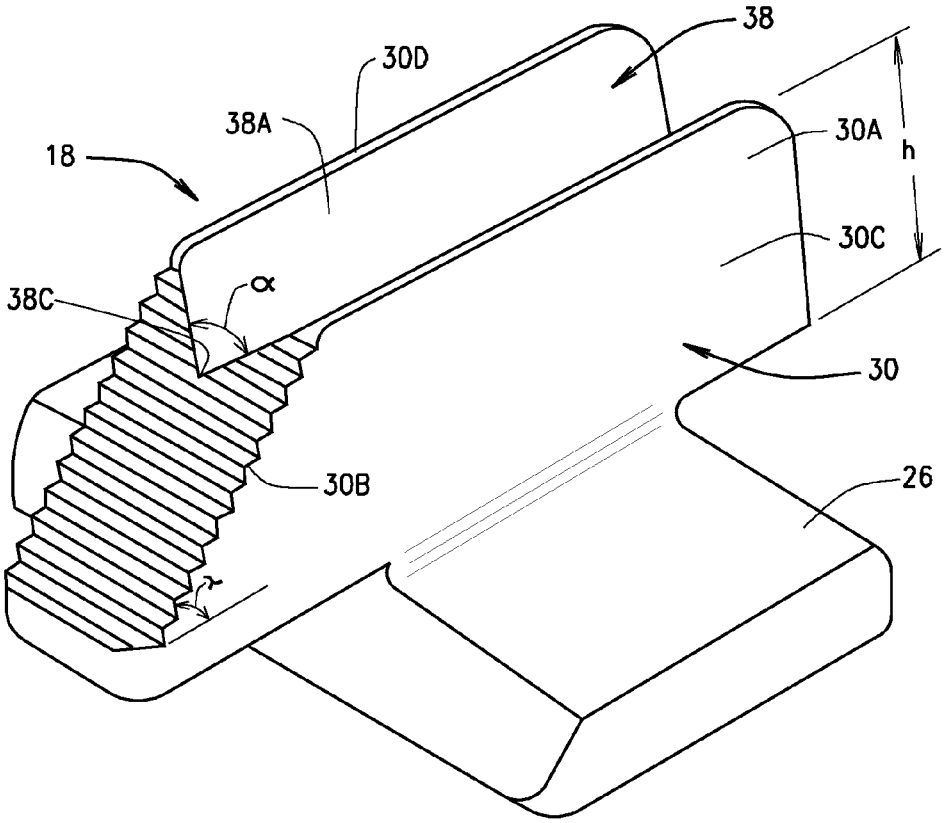
FIG. 2A is an isometric view of the front sight of the gun sight system shown in FIG. 1, in accordance with various embodiments of the present disclosure.
Figure 2B:
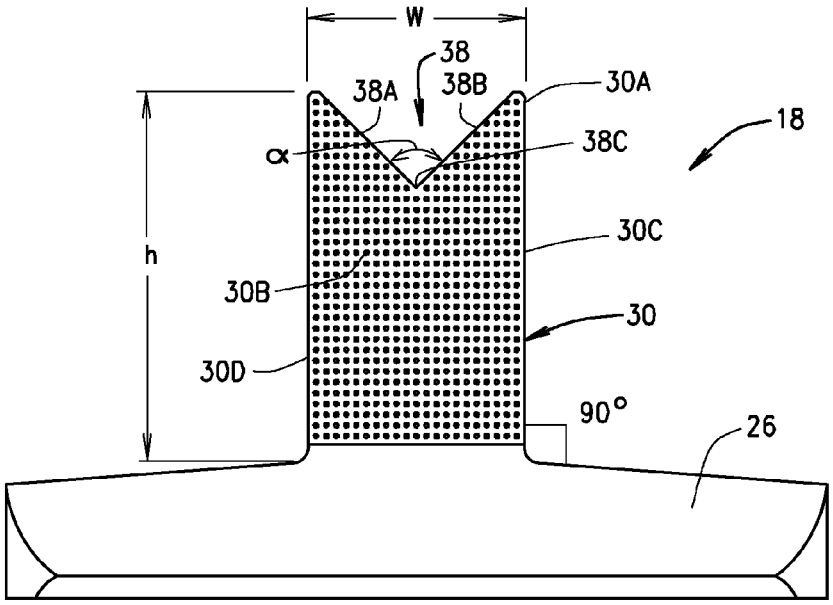
FIG. 2B is a rear view of the front sight of the gun sight system shown in FIG. 1, illustrating a high visibility marking disposed at least on the solid rear face of a V-shaped tip, in accordance with various embodiments of the present disclosure.

As exemplarily illustrated in FIG. 2A, in various embodiments the front sight sighting structure 30 can comprise a sloped rear face 30B that is sloped from the rear of the sighting structure 30 toward the front of the sighting structure 30 at an angle λ, e.g., 30°, 45°, 60°, etc. The sloped rear face 30B is advantageous in that it will reduced the occurrence of 'snagging' the front sight sighting structure 30 on clothing or a holster during handling of the respective firearm 14.

Referring now to FIGS. 3A, 3B, 4, 4A, 5, and 6, in various embodiments, a rear face 58A of the bridge 58 can include parallel registration lines, or indents, 64 that are separated a distance D that is substantially equal to a width W of the front sight sighting structure 30 as viewed by the user as he/she looks through the rear sight 22 longitudinally along the slide 34. The registration lines 64 can be used in addition to, or as an alternative to, forming the 'X' with the first and second walls 38A, 38B, 54A and 54B of the V-shaped notch 38 and the inverted-V-shaped stud 50, as described above, when sighing/aiming the respective firearm 14. More specifically, when a user looks longitudinally along the slide 34, the user can utilize his/her vernier acuity to quickly and accurately align sides 30C and 30D of the front sight sighting structure 30 with the registration lines 64 to quickly and accurately align the front sight sighting structure 30 with the rear sight sighting stud 50.

Figure 5:
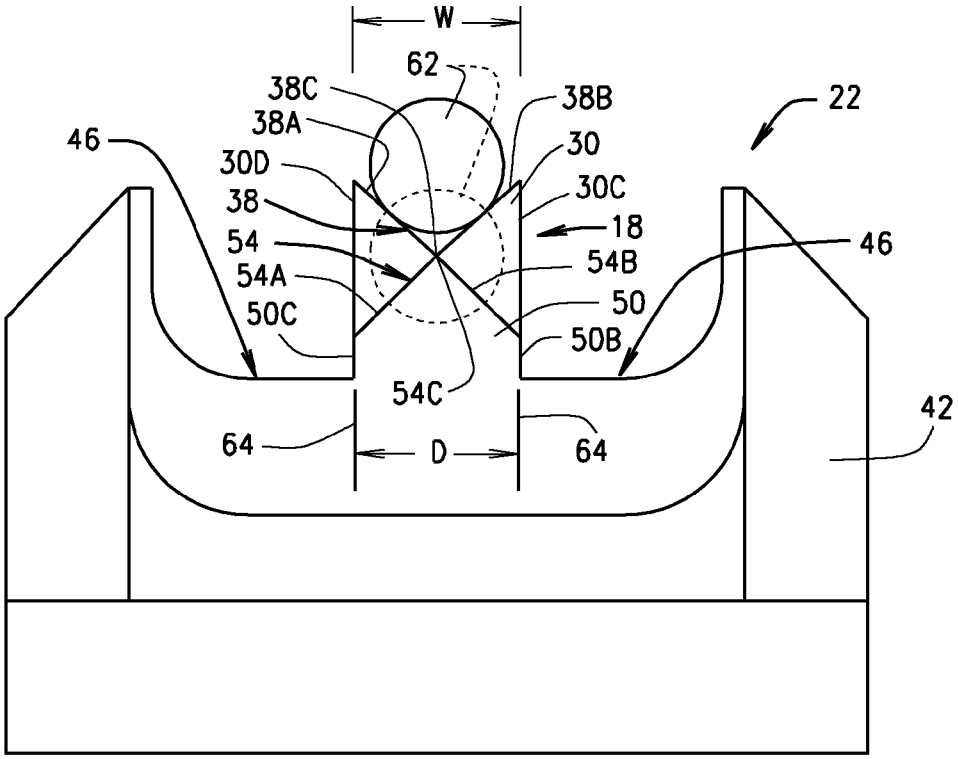
FIG. 5 is an illustration of the front and rear sights of the sighting system shown in FIG. 1 as viewed by a user looking longitudinally along a slide or barrel of the respective firearm, wherein the front and rear sights are aligned for proper sighting of a target, in accordance with various embodiments of the present disclosure.

Referring now to FIGS. 3 and 5, in the various embodiments wherein the rear sight sighting stud 50 has a longer length L (e.g., 1/16 inch to ¾ inch or greater), the sighting stud 50 can be structured to have the width D that is substantially equal to a width W of the front sight sighing structure, as viewed by the user as he/she looks through the rear sight 22 longitudinally along the slide 34, such that the sides 50B and 50C of the sighing stud 50 provide, or serve as, parallel registration lines. Particularly, in such embodiments the sides 50B and 50C of the sighting stud 50 can be used as registration lines in addition to, or as an alternative to, forming the 'X' with the first and second walls 38A, 38B, 54A and 54B of the V-shaped notch 38 and the inverted-V-shaped stud 50, as described above, when sighing/aiming the respective firearm 14. More specifically, when a user looks longitudinally along the slide 34, the user can utilize his/her vernier acuity to quickly and accurately align sides 30C and 30D of the front sight sighting structure 30 with the sides 50B and 50C of the rear sight sighting stud 50 to quickly and accurately align the front sight sighting structure 30 with the rear sight sighting stud 50.

Referring now to FIG. 6, in various embodiments, the rear sight sighting stud 50 can comprise just the inverted-V-shaped tip 54 extending from the top surface of the bridge 58. Additionally, in such embodiments, the rear face 58A of the bridge 58 can include extension lines, or indents, 74 that extend collinearly from the first and second walls 54A and 54B of the inverted-V-shaped tip 54, thereby visually extending the height and width of the inverted-V-shaped tip 54. Accordingly, when a user looks longitudinally along the slide 34 to align the rear sight sighting stud apex 54C with the front sight sighting structure nadir 38C, as described above, the combination of the first and second walls 54A and 54B with the extension lines 74 will give the appearance that the inverted-V-shaped tip 54 has a height and width substantially the same as the height and width of the V-shaped notch 38 of the front sight sighting structure 30. Additionally, this visual size effect of the inverted-V-shaped tip 54 can be enhanced, or maximized, if the rear face of the inverted-V-shaped tip 54 and the space between the extension lines 74 has a high visibility marking, described above, disposed thereon (shown as speckled marks in FIG. 6). Moreover, in various implementations, the rear face 58A of the bridge 58 can include registration lines 64 that can be used in addition to, or as an alternative to, forming the 'X' with the first and second walls 38A, 38B, 54A and 54B of the V-shaped notch 38 and the inverted-V-shaped stud 50, as described above, when sighting/aiming the respective firearm 14.

Referring now to FIG. 7, in various embodiments, the rear face 58A of the bridge 58 can include inverted-V-shaped tip lines, or indents, 78 disposed on the bridge face 58A at the angle β that form or define the inverted-V-shaped tip 54. In such embodiments, the inverted-V-shaped tip lines 78 provide the first and second walls 54A and 54B of the inverted-V-shaped tip 54, as described above. Accordingly, to aim/sight the firearm 14, the user looks longitudinally along the slide 34 and aligns the apex 54C of the inverted-V-shape tip 54, as defined by the inverted-V-shaped tip lines 78, with the front sight sighting structure nadir 38C, as described above. Additionally, in such embodiments, the predominance and visibility of the inverted-V-shaped tip 54 can be enhanced, or maximized, if the space between the inverted-V-shaped tip lines 78 has a high visibility marking, described above, disposed thereon (shown as speckled marks in FIG. 7).

Referring now to FIG. 1 through 7, in yet other embodiments, the front sight sighting structure 30 can be comprised of a fiber optic plastic that is structured and operable to illuminate the distal end 30A, including the V-shaped notch 38. Similarly, in various embodiments rear sight sighting stud 50 can be comprised of a fiber optic plastic that is structured and operable to illuminate the distal end 50A, including the inverted-V-shaped tip 54. Furthermore, in various implementations, the fiber optic plastic of the front sight sighting structure 30 can be structured and operable to illuminate a first color, and the fiber optic plastic of the rear sight sighting stud 50 can be structured and operable to illuminate a second color that is different than the first color of the front sight sighting structure 30. For example, the first and second colors can be highly contrasting colors such that the respective colors, and hence the sighting structure V-shaped notch 38 and the sighting stud inverted-V-shaped tip 54, are clearly distinguishable from each other and thereby assist the user in aligning the apex 54C of rear sight inverted-V-shaped tip 54 with the nadir 38C of front sight sighting structure V-shaped notch 38 to quickly and accurately sight the firearm 14.

In still other embodiments, the front sight sighting structure 30 can comprise one or more self-luminescent sources or devices that is/are structured and operable to illuminate the distal end 30A, including the V-shaped notch 38. For example, in various implementations, the front sighting structure 30 can include one or more Tritium inserts embedded in the rear face of the sighting structure 30. Similarly, in various embodiments rear sight sighting stud 50 can comprise one or more self-luminescent sources or devices that is/are structured and operable to illuminate the distal end 50A, including the inverted-V-shaped tip 54. For example, in various implementations, the rear sighting stud 50 can include one or more Tritium inserts embedded in the rear face of the sighting stud 50. Furthermore, in various implementations, the self-luminescent source(s) or device(s) of the front sight sighting structure 30 can be structured and operable to illuminate a first color, and the self-luminescent source(s) or device(s) of the rear sight sighting stud 50 can be structured and operable to illuminate a second color that is different than the first color of the front sight sighting structure self-luminescent source or device. For example, the first and second colors can be highly contrasting colors such that the respective colors, and hence the sighting structure V-shaped notch 38 and the sighting stud inverted-V-shaped tip 54, are clearly distinguishable from each other and thereby assist the user in aligning the apex 54C of rear sight inverted-V-shaped tip 54 with the nadir 38C of front sight sighting structure V-shaped notch 38 to quickly and accurately sight the firearm 14.

Still referring to FIGS. 1 through 7, as described above, when using the sight system 10 to sight, i.e., aim, the firearm 14 the user readily and easily aligns the apex 54C of the rear sight sighting stud inverted-V-shaped tip 54 with the nadir 38C of the front sight sighting structure V-shaped notch 38 such that the inverted-V-shaped tip 54 the V-shaped notch 38 form an 'X'. The alignment of the apex 54C with the nadir 38C to form the 'X' is easily and very accurately done as a result of the vernier acuity of the user. Subsequently, the user then aligns the single point at which the apex 54C meets the nadir 38C, i.e., the center or intersection of the 'X', with the target 62, or alternatively nests the target 62 within the V-shaped notch 38.

Notably, as described above, when the user is sighting/aiming the firearm 14, using the sight system 10, the user places the inverted-V-shaped tip 54 of the rear sight sighting stud 50 below the V-shaped notch 38 of the front sight sighting structure 30. Placing the rear sight of a firearm below the front sight of a firearm is the well-established and naturally intuitive manner in which a user sights/aims a firearm. Hence, use of the sight system 10 employs the natural muscle memory and physical intuition of the user as the user sights/aims the respective firearm 14. Therefore, users of the sight system 10, as described herein, will easily and intuitively be able to utilize the sight system 10 to quickly and accurately sight/aim the respective firearm 14. Moreover, users will be able to easily and intuitively, and quickly and accurately, sight/aim the respective firearm 14 with a stationary target and a moving target due to the open view provided by the wide rear sight channel 46.

Furthermore, the opaque solid structure of front sight sighting structure 30 and the opaque solid rear sight sighting stud 50 allow for the vernier acuity of the user to easily and readily form the 'X' that results from aligning the apex 54C of inverted-V-shaped tip 54 with the nadir 38C of the V-shaped notch 38. Particularly, the opaque solid structure of the front sight sighting structure 30 and the opaque solid rear sight sighting stud 50 blocks the portion of the down-range view that is optically behind the front sight sighting structure 30 and the rear sight sighting stud 50. The opaque and solid structure of the front sight sighting structure 30 and the rear sight sighting stud 50 eliminates optical confusion and busyness at, and beyond, the front sight sighting structure 30 and the rear sight sighting stud 50, such that the users vernier acuity is not inhibited or confused, thereby allowing the user to quickly and easily align the apex 54C of inverted-V-shaped tip 54 with the nadir 38C of the V-shaped notch 38 to form the 'X'.

Figure 3A:
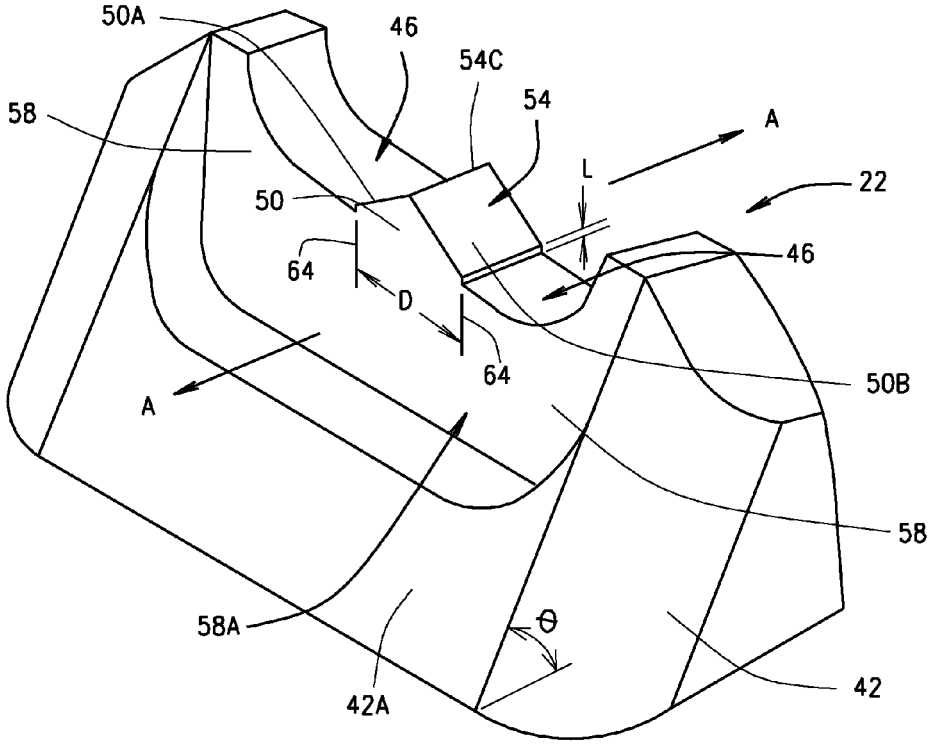
FIG. 3A is an isometric view of the rear sight of the gun sight system shown in FIG. 1, in accordance with various other embodiments of the present disclosure.
Figure 3B:
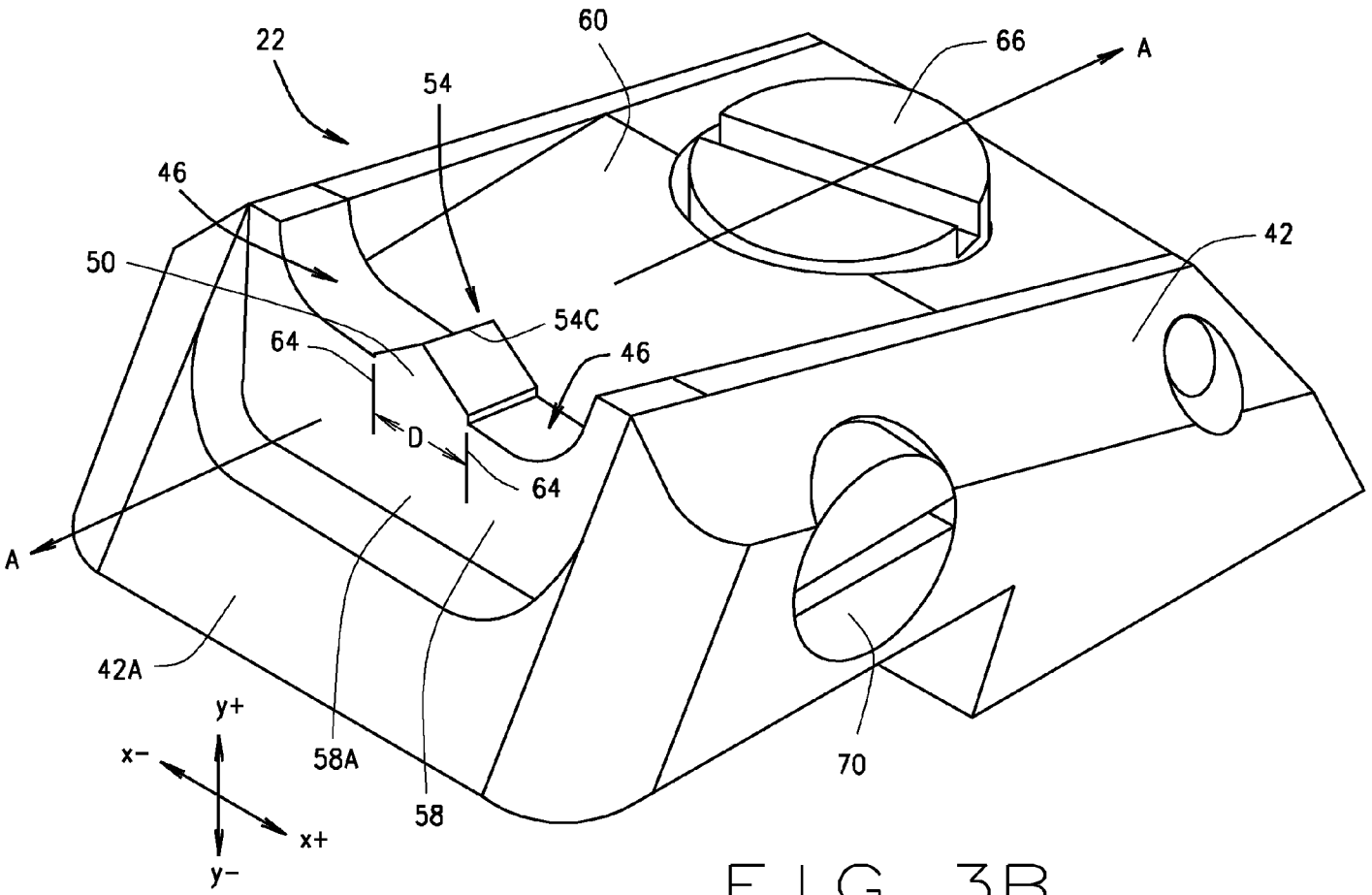
FIG. 3B is an isometric view of the rear sight of the gun sight system shown in FIG. 1 having registration lines, in accordance with various other embodiments of the present disclosure.

Still further, as illustrated in FIGS. 3, 3A and 3B, in various embodiments a rear face 42A of the rear sight body 42 can be sloped from the rear the body 42 toward a front of the body 42 at an angle $\phi$, e.g., 30°, 45°, 60°, etc. The sloped rear face 42A is advantageous in that it will reduced the occurrence of 'snagging' the rear sight sighting stud 50 on clothing or a holster during handling of the respective firearm 14. Hence, the sloped rear face 42A of the rear sight body 42 in combination with the sloped rear face 30B of the front sight sighting structure 30 provide an substantially 'snag free' design of the sight system 10. That is, the sloped rear face 42A of the rear sight body 42 in combination with the sloped rear face 30B of the front sight sighting structure 30 significantly reduce the susceptibility of snagging the front and/or rear sights 18 and 22 on surrounding articles, e.g., a holster or the users clothing during handling and use of the respective firearm 14.

Hence, as described above, the sights system 10 provides a dual purpose sight system for a firearm, e.g., a pistol, rifle or shotgun. That is, the sight system 10 will allow the user to view the target 62 for a precise shot placement if needed, such as in bulls eye competition, while at the same time allowing the user to have a broader, panoramic view of moving targets, such as is needed in a timed shooting event, for example IPSC (International Practical Shooting Confederation or IDPA (International Defensive Pistol Association) style events.

Additionally, the utilization of the users vernier acuity to align the walls 54A and 54B of the rear sight sighting stud 50 with the walls 38A and 38B of the front sight sighting structure 30 to form the 'X', and hence provide a single point of alignment with the target 62, i.e., the point and the center/intersection of the 'X', where the rear sight sighting stud apex 54C is aligned with the front sight sighting structure nadir 38C, eliminates the need to align, and visual and mentally estimate, three object lines along with a target, as is necessary with known sight systems. Particularly, with known sight systems the user must visually and mentally estimate alignment of the top of the front sight blade with the top of the rear sight closed bridge having a notch therein (first object line), then visually and mentally estimate alignment of both sides of the front sight blade to be equally spaced from the respective sidewalls of the notch in the rear sight bridge (second and third object lines). The sight system 10, as described herein, requires only a single point of alignment that utilizes the user's vernier acuity such that sighting/aiming the respective firearm 14 does not require visual or mental estimation. Thus, the sight system 10 provides the user with greater ease, maximum visibility and maximum precision of sighting together with increased speed of aligning the sights at all ranges whether close or far.

Furthermore, the sight system 10, as described herein, allows for both slow precise and rapid shots to be taken at various different targets (or various portions of a target) whether the target is moving or is stationary, is at close or long range, and where either approximate or precise alignment must be made quickly, therefore the sight system 10 provides a dual purpose sight system.

Although the sight system 10 has been described above to include both the front and rear sights 18 and 22, it is envisioned that the front sight 18 and/or rear sight 22, as described above and shown in the various figures, can be employed independently of one another and are not limited to being used in combination. That is, it is envisioned that the front sight 18, as described above, can be used in combination with any other known or unknown rear sight to enable the user to easily and intuitively, and quickly and accurately, sight/aim the respective firearm 14 with a target utilizing the user's vernier acuity, and remain within the scope of the present disclosure. Similarly, it is envisioned that the rear sight 22, as described above, can be used in combination with any other known or unknown front sight to enable the user to easily and intuitively, and quickly and accurately, sight/aim the respective firearm 14 with a target utilizing the user's vernier acuity, and remain within the scope of the present disclosure.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A gun sight system, said system comprising:

a front sight comprising:

a base structured and operable to mount the front sight to a distal end of a slide of a firearm;

a sighting structure extending from the base longitudinally along the slide parallel to a longitudinal axis of the slide, the sighting structure having a top that comprises a first wall extending longitudinally along the top parallel to a longitudinal axis of the slide and a second wall extending longitudinally along the top parallel to a longitudinal axis of the slide, the second wall connected to the first wall to form a 'V-shaped' notch extending longitudinally along the top of the sighting structure; and a rear sight comprising:

a body including a bridge formed in a top of the body, the bridge having an 'inverted-V-shaped' tip disposed thereon such that when a user looks longitudinally along the top of the slide, the user can align an apex of the rear sight 'inverted-V-shaped' tip with a nadir of the front sight 'V-shaped' notch with at least a portion of the target nested within the front sight 'V-shaped' notch to accurately aim the firearm, wherein the front sighting structure and the rear sight 'inverted-V-shaped' tip are solid and visually opaque such that the front sighting structure and the rear sight 'inverted-V-shaped' tip block the portion of a down-range view that is optically behind the front sight sighting structure and the rear sight 'inverted-V-shaped' tip.

2. The system of claim 1, wherein the body is structured and operable to mount the rear sight to a proximal end of the slide, and the bridge defines a sight channel such that when a user looks longitudinally along the top of the slide, the sight channel provides a field of view that includes the front sight sighting structure, a target and a panoramic view of the area around the target.

3. The system of claim 1, wherein the rear sight further comprises a sighting stud extending orthogonally from a bottom surface of the sight channel such that the sighting stud extends substantially orthogonally from the slide.

4. The system of claim 1, wherein:

the front sight 'V-shaped' notch includes a first wall connected to a second wall at the nadir of the 'V-shaped' notch to form the 'V-shaped' notch; and the rear sight 'inverted-V-shaped' tip includes a first wall connected to a second wall at the apex of the 'inverted-V-shaped' tip to form the 'inverted-V-shaped' tip, wherein an angle formed at the connection of the first and second walls of the 'V-shaped' notch is substantially the same as an angle formed at the connection of the first and second walls of the 'inverted-V-shaped' tip.

5. The system of claim 1, wherein:

the front sight sighting structure includes a high visibility marking disposed at the top; and the rear sight includes a high visibility marking disposed at least on the 'inverted-V-shaped' tip that visually contrasts with the front sight highly visible marking, such that the highly visible markings of the front and rear sights are clearly distinguishable from each other as the user aligns the rear sight 'inverted-V-shaped' tip with the front sight sighting structure 'V-shaped' notch.

6. The system of claim 1, wherein at least one of the front sight sighting structure and the rear sight 'inverted-V-shaped' tip are comprised of a fiber optic plastic structured and operable to illuminate the at least one of the front sight sighting structure and the rear sight 'inverted-V-shaped' tip.

7. The system of claim 1, wherein at least one of the distal end of the front sight sighting structure and the rear sight 'inverted-V-shaped' tip comprises self-luminescent source structured and operable to illuminate the at least one of the front sight sighting structure and the rear sight 'inverted-V-shaped' tip.

8. The system of claim 1, wherein:

the front sight 'V-shaped' notch includes a first wall connected to a second wall at the nadir of the 'V-shaped' notch to form the 'V-shaped' notch; and the rear sight 'inverted-V-shaped' tip includes a first wall connected to a second wall at the apex of the 'inverted-V-shaped' tip to form the 'inverted-V-shaped' tip, wherein when the user aligns the apex of the rear sight 'inverted-V-shaped' tip with the nadir of the front sight 'V-shaped' notch with the target nested within the front sight 'V-shaped' notch, the walls of the rear sight 'inverted-V-shaped' tip and the walls front sight 'V-shaped' notch form an 'X' pattern such that the user can utilize vernier acuity of the eye to aim the firearm.

9. The system of claim 1, wherein a rear face of the bridge includes parallel registration lines that are structure and operable to utilize the vernier of the user's eye align sides of the front sight sighting structure with the registration lines.

10. The system of claim 1, wherein a rear face of the bridge comprises inverted-V-shaped tip lines disposed that define the 'inverted-V-shaped' tip.

11. A gun sight system, said system comprising:

a front sight comprising:

a base structured and operable to mount the front sight to a distal end of a slide of a firearm;

a sighting structure extending orthogonally from the base such that the sighting structure extends substantially orthogonally from the slide and longitudinally along the slide parallel to a longitudinal axis of the slide, the sighting structure having a 'V-shaped' notch extending longitudinally along a top of the sight structure, the 'V-shaped' notch including a first wall extending longitudinally along the top parallel to a longitudinal axis of the slide connected to a second wall extending longitudinally along the top parallel to a longitudinal axis of the slide at a nadir of the 'V-shaped' notch to form the 'V-shaped' notch; and a rear sight comprising:

a body structured and operable to mount the rear sight to a proximal end of the slide, the body including a bridge formed in a top of the body, the bridge defining a sight channel such that when a user looks longitudinally along the top of the slide, the sight channel provides a field of view that includes the front sight sighting structure, a target and a panoramic view of the area around the target;

an 'inverted-V-shaped' tip disposed on the bridge, the 'inverted-V-shaped' tip including a first wall connected to a second wall at the apex of the 'inverted-V-shaped' tip to form the 'inverted-V-shaped' tip, such that when a user looks longitudinally along the top of the slide, the user can align an apex of the rear sight 'inverted-V-shaped' tip with a nadir of the front sight 'V-shaped' notch with the target nested within the front sight 'V-shaped' notch, such that the walls of the rear sight 'inverted-V-shaped' tip and the walls front sight 'V-shaped' notch form an 'X' pattern such that the user can utilize vernier acuity of the eye to accurately aim the firearm, wherein the front sighting structure and the rear sight 'inverted-V-shaped' tip are solid and visually opaque such that the front sighting structure and the rear sight 'inverted-V-shaped' tip block the portion of a down-range view that is optically behind the front sight sighting structure and the rear sight 'inverted-V-shaped' tip.

12. The system of claim 11, wherein the rear sight further comprises a sighting stud extending orthogonally from a bottom surface of the sight channel such that the sighting stud extends substantially orthogonally from the slide.

13. The system of claim 11, wherein an angle formed at the connection of the first and second walls of the 'V-shaped' notch is substantially the same as an angle formed at the connection of the first and second walls of the 'inverted-V-shaped' tip.

14. The system of claim 11, wherein:

the front sight sighting structure includes a high visibility marking disposed at the top; and the rear sight includes a high visibility marking disposed at least on the 'inverted-V-shaped' tip that visually contrasts with the front sight highly visible marking, such that the highly visible markings of the front and rear sights are clearly distinguishable from each other as the user aligns the rear sight 'inverted-V-shaped' tip with the front sight sighting structure 'V-shaped' notch.

15. The system of claim 11, wherein at least one of the front sight sighting structure and the rear sight 'inverted-V-shaped' tip are comprised of a fiber optic plastic structured and operable to illuminate the at least one of the front sight sighting structure and the rear sight 'inverted-V-shaped' tip.

16. The system of claim 11, wherein at least one of the distal end of the front sight sighting structure and the rear sight 'inverted-V-shaped' tip comprises self-luminescent source structured and operable to illuminate the at least one of the front sight sighting structure and the rear 'inverted-V-shaped' tip.

17. The system of claim 11, wherein a rear face of the bridge includes parallel registration lines that are structure and operable to utilize the vernier of the user's eye align sides of the front sight sighting structure with the registration lines.

18. The system of claim 11, wherein a rear face of the bridge comprises inverted-V-shaped tip lines disposed that define the 'inverted-V-shaped' tip.

19. A firearm, said firearm comprising:

a gun sight system, said system comprising:

a front sight comprising:

a base structured and operable to mount the front sight to a distal end of a slide of a firearm;

a sighting structure extending orthogonally from the base such that the sighting structure extends substantially orthogonally from the slide and longitudinally along the slide parallel to a longitudinal axis of the slide, the sighting structure having a top that comprises a first wall extending longitudinally along the top parallel to a longitudinal axis of the slide and a second wall extending longitudinally along the top parallel to a longitudinal axis of the slide, the second wall connected to the first wall to form a 'V-shaped' notch extending longitudinally along the top of the sighting structure; and a rear sight comprising:

a body structured and operable to mount the rear sight to a proximal end of the slide, the body including a bridge formed in a top of the body, the bridge defining a sight channel such that when a user looks longitudinally along the top of the slide, the sight channel provides a field of view that includes the front sight sighting structure, a target and a panoramic view of the area around the target; an 'inverted-V-shaped tip disposed on the bridge, the 'inverted-V-shaped' tip including a first wall connected to a second wall at the apex of the 'inverted-V-shaped' tip to form the 'inverted-V-shaped' tip, such that when a user looks longitudinally along the top of the slide, the user can align an apex of the rear sight 'inverted-V-shaped' tip with a nadir of the front sight 'V-shaped' notch with the target nested within the front sight 'V-shaped' notch to accurately aim the firearm, wherein the front sighting structure and the rear sight 'inverted-V-shaped' tip are solid and visually opaque such that the front sighting structure and the rear sight 'inverted-V-shaped' tip block the portion of a down-range view that is optically behind the front sight sighting structure and the rear sight 'inverted-V-shaped' tip.

20. The firearm of claim 19, wherein:

the front sight 'V-shaped' notch includes a first wall connected to a second wall at the nadir of the 'V-shaped' notch to form the 'V-shaped' notch; and the rear sight 'inverted-V-shaped' tip includes a first wall connected to a second wall at the apex of the 'inverted-V-shaped' tip to form the 'inverted-V-shaped' tip, wherein an angle formed at the connection of the first and second walls of the 'V-shaped' notch is substantially the same as an angle formed at the connection of the first and second walls of the 'inverted-V-shaped' tip.

21. The firearm of claim 19, wherein:

the front sight sighting structure includes a high visibility marking disposed at the top; and the rear sight includes a high visibility marking disposed at least on the 'inverted-V-shaped' tip that visually contrasts with the front sight highly visible marking, such that the highly visible markings of the front and rear sights are clearly distinguishable from each other as the user aligns the rear sight 'inverted-V-shaped' tip with the front sight sighting structure 'V-shaped' notch.

22. The firearm of claim 19, wherein at least one of the front sight sighting structure and the rear sight 'inverted-V-shaped' tip are comprised of a fiber optic plastic structured and operable to illuminate the at least one of the front sight sighting structure and the rear sight 'inverted-V-shaped' tip.

23. The firearm of claim 19, wherein at least one of the distal end of the front sight sighting structure and the rear sight 'inverted-V-shaped' tip comprises self-luminescent source structured and operable to illuminate the at least one of the front sight sighting structure and the rear 'inverted-V-shaped' tip.

24. The firearm of claim 19, wherein:

the front sight 'V-shaped' notch includes a first wall connected to a second wall at the nadir of the 'V-shaped' notch to form the 'V-shaped' notch; and the rear sight 'inverted-V-shaped' tip includes a first wall connected to a second wall at the apex of the 'inverted-V-shaped' tip to form the 'inverted-V-shaped' tip, wherein when the user aligns the apex of the rear sight 'inverted-V-shaped' tip with the nadir of the front sight 'V-shaped' notch with the target nested within the front sight 'V-shaped' notch, the walls of the rear sight 'inverted-V-shaped' tip and the walls front sight 'V-shaped' notch form an 'X' pattern such that the user can utilize vernier acuity of the eye to aim the firearm.

25. The firearm of claim 19, wherein a rear face of the bridge includes parallel registration lines that are structure and operable to utilize the vernier of the user's eye align sides of the front sight sighting structure with the registration lines.

26. The firearm of claim 19, wherein a rear face of the bridge comprises inverted-V-shaped tip lines disposed that define the 'inverted-V-shaped' tip.

27. The system of claim 1, wherein the 'inverted-V-shaped' tip of the rear sight has a width that is substantially equal to a width of the front sighting structure.

* * * * *